US007282138B2

(12) United States Patent
Ellis et al.

(10) Patent No.: US 7,282,138 B2
(45) Date of Patent: Oct. 16, 2007

(54) MULTISTAGE REMOVAL OF HETEROATOMS AND WAX FROM DISTILLATE FUEL

(75) Inventors: Edward S. Ellis, Falls Church, VA (US); Ramesh Gupta, Berkeley Heights, NJ (US); William J. Novak, Great Falls, VA (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 208 days.

(21) Appl. No.: 10/938,301

(22) Filed: Sep. 10, 2004

(65) Prior Publication Data

US 2005/0092654 A1 May 5, 2005

Related U.S. Application Data

(60) Provisional application No. 60/517,471, filed on Nov. 5, 2003.

(51) Int. Cl.
*C10G 69/02* (2006.01)

(52) U.S. Cl. ..... 208/89; 208/27

(58) Field of Classification Search ..... 208/27, 208/89

See application file for complete search history.

(56) References Cited

U.S. PATENT DOCUMENTS

| | | | | |
|---|---|---|---|---|
| 4,358,362 A | | 11/1982 | Smith et al. | 208/91 |
| 4,394,249 A | | 7/1983 | Shen | 208/89 |
| 4,436,614 A | | 3/1984 | Olbrich et al. | 208/89 |
| 4,597,854 A | | 7/1986 | Penick | 208/58 |
| 4,648,957 A | | 3/1987 | Graziani et al. | 208/58 |
| 4,846,959 A | | 7/1989 | Kennedy et al. | 208/97 |
| 4,913,797 A | | 4/1990 | Albinson et al. | 208/89 |
| 4,917,789 A | * | 4/1990 | Butler et al. | 208/89 |
| 5,015,359 A | | 5/1991 | Harandi et al. | 208/58 |
| 5,670,116 A | | 9/1997 | Gupta et al. | 422/191 |
| 5,705,052 A | | 1/1998 | Gupta | 208/57 |
| 5,720,872 A | | 2/1998 | Gupta | 208/57 |
| 6,103,104 A | | 8/2000 | Gupta | 208/210 |
| 6,623,622 B2 | | 9/2003 | Gupta | 208/59 |

FOREIGN PATENT DOCUMENTS

| | | |
|---|---|---|
| WO | WO97/18278 | 5/1997 |
| WO | WO97/23584 | 7/1997 |
| WO | WO02/31087 | 4/2002 |
| WO | WO02/38704 | 5/2002 |

* cited by examiner

*Primary Examiner*—Glenn Caldarola
*Assistant Examiner*—Prem C. Singh
(74) *Attorney, Agent, or Firm*—G. J. Hughes; Lawrence E. Carter

(57) ABSTRACT

A distillate fuel feed is hydrotreated to remove heteroatoms and then separated into light and heavy hydrotreated fractions, with the heavy fraction catalytically dewaxed to improve low temperature properties. The hydrotreating and dewaxing are conducted in separate stages, which may be in the same reactor vessel. Fresh hydrogen may be passed into the dewaxing stage, with the dewaxing stage gaseous effluent then passed into the hydrotreating stage to provide hydrogen for the hydrotreating. Existing hydrotreating reaction vessels and facilities may be retrofitted to add one or more dewaxing stages.

20 Claims, 2 Drawing Sheets

MULTISTAGE REMOVAL OF HETEROATOMS AND WAX FROM DISTILLATE FUEL

CROSS-REFERENCE TO RELATED APPLICATION

This application claims benefit of U.S. Provisional Patent Application Ser. No. 60/517,471 filed Nov. 5, 2003.

FIELD OF THE INVENTION

The invention relates to a multistage process for removing heteroatoms and wax from distillate fuel. In an embodiment, the process involves hydrotreating a distillate fuel feed to remove heteroatoms, separating the treated feed into light and heavy fractions, with the heavy fraction catalytically dewaxed.

BACKGROUND OF THE INVENTION

Middle distillate fuel stocks such as diesel, kerosene, jet fuel and home heating oil, are produced from distillate hydrocarbon feeds that contain undesirable components including aromatics and heteroatom compounds containing sulfur and nitrogen. Therefore, the distillate fuel feed is typically hydrotreated by reacting it with hydrogen in the presence of a hydrotreating catalyst, to remove the heteroatoms as $H_2S$ and $NH_3$, and remove some aromatics by saturation. These feeds also contain waxy hydrocarbon molecules. There are increasing requirements for distillate fuels to have better low temperature properties, including lower pour, cloud, freeze and fuel filter plugging temperatures and cold filter plugging point (CFPP). To obtain fuel stocks that will meet more severe cold temperature requirements, distillate fuel fractions must be dewaxed in addition to being hydrotreated. Various process schemes have been proposed and used for hydrotreating distillate fuel stocks, some of which incorporate catalytic dewaxing into the process, and sometimes into the same reactor vessel used for hydrotreating. Illustrative examples may be found, for example, in U.S. Pat. Nos. 4,358,362; 4,436,614; 4,597,854; 4,846,959; 4,913,797; 5,720,872; 5,705,052; and 6,103,104; and U.S. Patent Application No. 20020074262 A1. Since existing fuel hydrotreating facilities have neither dewaxing capability nor ground space available on which to add new units to provide it, there is a need for a process that will remove both heteroatoms and wax from distillate fuel feeds. Desirably, such a process could readily be adapted for use with existing hydrotreating facilities, with minimal investment in dewaxing equipment and facilities.

SUMMARY OF THE INVENTION

The present invention relates to a process for removing heteroatoms and wax from a distillate fuel feed which comprises (i) hydrotreating the feed in one or more hydrotreating reaction stages to produce a hydrotreated fuel reduced in heteroatoms, (ii) separating the treated fuel into a light and a heavy fraction, and (iii) dewaxing the heavy fraction in one or more dewaxing reaction stages to improve one or more low temperature properties. The heavy fraction comprises less than about 80 and preferably less than 60 vol. % of the feed. Separating and dewaxing only the hydrotreated heavy fraction, as compared to the total hydrotreated feed, enables the use of one or more of (a) less catalyst for dewaxing, (b) lower space velocity of the liquid through the dewaxing catalyst bed, with concomitant deeper dewaxing due to greater residence time, and (c) lower dewaxing temperature and pressure. In an embodiment, the hydrotreating conditions result in the vaporization of most, and preferably all of the light fraction, but not the waxy heavy fraction. In this embodiment the hydrotreating reaction products comprise the hydrotreated liquid heavy fraction and a gaseous effluent comprising the hydrotreated and vaporized light fraction, along with gaseous reaction products which include unreacted hydrogen, $H_2S$ and $NH_3$. The hydrotreated liquid heavy fraction is separated from the gaseous effluent. The gaseous effluent is cooled to condense the hydrotreated light fraction to liquid, which is then separated from the gaseous reaction products. If desired, all or a portion of the hydrotreated light fraction may be recombined with all or a portion the hydrotreated and dewaxed heavy fraction.

Dewaxing catalysts are known to be sensitive to organic heteroatom-containing compounds, $NH_3$ and $H_2S$. Catalysts that dewax mostly by isomerization with minimal cracking of the feed to lower boiling hydrocarbons are typically particularly sensitive. In an embodiment, therefore, the hydrotreated heavy fraction liquid be stripped to remove dissolved $H_2S$ and $NH_3$ before it is dewaxed. Following dewaxing, the hydrotreated and dewaxed heavy fraction, and the hydrotreated light fraction, are typically stripped to remove residual and dissolved heteroatoms, gas and other impurity species, either separately or as a recombined stream. A single stripping vessel with separate stripping stages may be used to strip (a) the hydrotreated heavy fraction liquid prior to and after dewaxing, (b) the hydrotreated and condensed light fraction liquid, and/or (c) the recombined stream comprising the hydrotreated and dewaxed heavy fraction and hydrotreated light fraction. In another embodiment, any of these three streams may be hydrofinished, with or without prior stripping, to form a fuel stock. In a preferred embodiment, fresh hydrogen treat gas is introduced into the one or more dewaxing stages, with unreacted hydrogen from the dewaxing used for hydrotreating.

A more detailed embodiment of the invention comprises (a) passing hydrogen and a wax and heteroatom-containing distillate fuel feed into one or more hydrotreating stages, at reaction conditions effective for the feed and hydrogen to react in the presence of a catalytically effective amount of hydrotreating catalyst, to produce a feed reduced in heteroatoms, (b) separating the heteroatom-reduced feed into a light fraction and a heavy fraction liquid, and (c) passing the separated heavy fraction liquid and hydrogen into one or more dewaxing reaction stages, at reaction conditions effective for the hydrogen to react with the heavy fraction in the presence of a catalytically effective amount of a dewaxing catalyst, to improve one or more of the fuel's low temperature properties. The preferred embodiment in which the hydrotreating reaction vaporizes the light fraction, eliminates the need for distillation or fractionation external of the hydrotreating reactor. In this embodiment the process comprises (a) passing hydrogen and a wax and heteroatom-containing distillate fuel feed into one or more hydrotreating stages, at reaction conditions effective for the feed and hydrogen to react in the presence of a hydrotreating catalyst, to (i) produce a feed reduced in heteroatoms and (ii) vaporize at least a portion of the lighter feed components to produce a light fraction vapor and a heavy fraction liquid, (b) separating the heavy fraction liquid from the light fraction vapor, and (c) passing the heavy fraction liquid and hydrogen into one or more dewaxing reaction stages, at reaction conditions effective for the hydrogen to react with the heavy fraction in the presence of a catalytically effective amount of a dewaxing catalyst, in order to improve one or more of the feed's low temperature properties.

The process can be retrofitted into an existing distillate fuel hydrotreating unit, which typically operates at a similar, but sometimes lower, temperature and pressure than a typical catalytic dewaxing unit. This is because hydrotreating, and preferably hydrotreating combined with stripping the waxy heavy fraction to remove the heteroatom impurities prior to dewaxing, permits the use of lower dewaxing temperatures and pressures. Lowering the dewaxing temperature and pressure, and particularly the pressure, makes it easier for both hydrotreating and dewaxing to be achieved in the same reaction vessel at the same time. Thus, another embodiment relates to retrofitting or adding catalytic dewaxing capability to an existing distillate fuel hydrotreating facility. In this embodiment, (a) one or more catalytic dewaxing stages are added to a distillate fuel hydrotreating facility comprising one or more hydrotreating stages and (b) employing the process steps comprising hydrotreating, separation and dewaxing only the hydrotreated heavy fraction, etc., including any or all the various embodiments set forth above. The one or more dewaxing stages can be in a separate reactor added to the facility, but in at least some cases they may be added to an existing hydrotreating reactor, either internally in the reactor or as an extension welded to the top of the reactor and more preferably interior of the reactor with gas communication, but not with liquid communication, between the one or more dewaxing and hydrotreating stages. In an embodiment, one or more hydrotreating stages in a hydrotreating reactor are converted to one or more dewaxing stages. If the hydrotreating reactor has interstage gas-liquid separation trays, then hydrotreating catalyst in one or more hydrotreating stages may be replaced with dewaxing catalyst.

DETAILED DESCRIPTION

Figure 1:
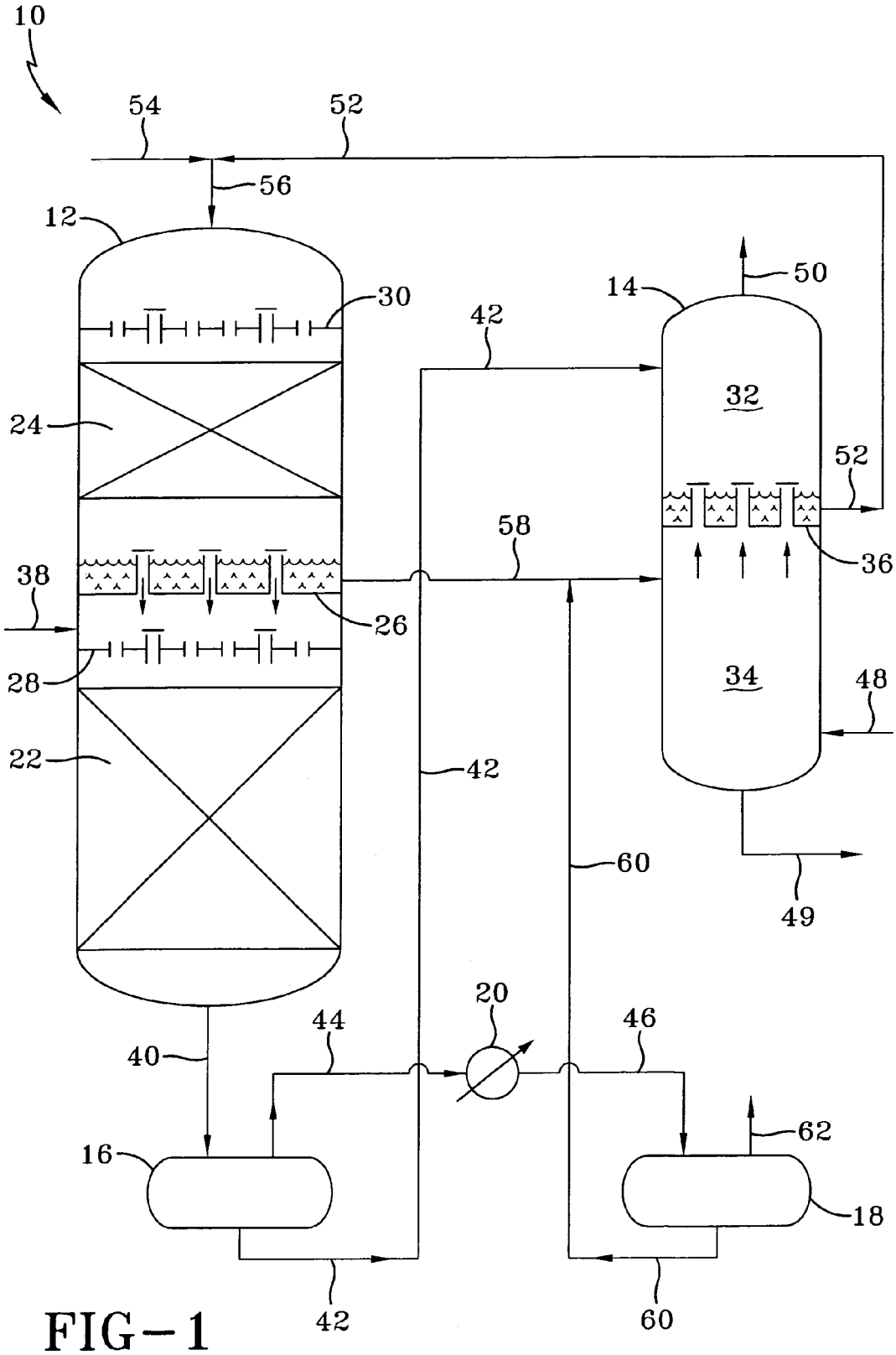
FIG. 1 schematically illustrates a flow diagram of an embodiment having the hydrotreating and dewaxing in the same vessel.

The invention relates to a method for upgrading a hydrocarbon by hydrotreating and dewaxing. In an embodiment, the hydrocarbon feed is a distillate fuel feed comprising a hydrocarbon fraction boiling generally in the diesel and jet fuels range, which may broadly range between about 300 to about 700° F. (about 149 to about 371° C.) and more typically about 400 to about 650° F. (about 204 to about 343° C.). In an embodiment, the cut point separating the heavy fraction from the lighter fraction is typically in the range of from about 450 to about 580° F. (about 232 to about 304° C.). Most of the wax is concentrated in the heavy fraction; consequently, only the heavy grade need be dewaxed in order to obtain improved low temperature properties. This heavy fraction is typically less than about 80 and preferably less than about 60 vol. % of the total liquid feed. Major benefits are achieved by hydrotreating to remove heteroatom impurities prior to dewaxing and by dewaxing only the separated heavy fraction. For a given dewaxing reaction stage volume, reducing the volume of waxy feed being dewaxed results in an increased residence time for the waxy liquid and a concomitant increased hydrogen treat gas to waxy hydrocarbon ratio in the dewaxing stage(s). Alternately, less dewaxing catalyst can be used to achieve the same level of dewaxing and, therefore, a smaller dewaxing stage can be used, resulting in a desirable decrease in the dewaxing reaction residence time. Removal of the heteroatom impurities prior to dewaxing results in greater catalyst dewaxing activity and this too enables the use of less catalyst and a smaller stage. In a combined hydrotreater/dewaxer reactor retrofit, a smaller dewaxing stage would make more space available for hydrotreating catalyst. Moreover, employing a smaller dewaxing stage enables the addition of a smaller dewaxing reactor or combined dewaxing and hydrotreating reactor to an existing hydrotreating facility, if it is not possible to add a dewaxing stage to an existing hydrotreating reactor. Another benefit of heteroatom removal prior to dewaxing is that the dewaxing reaction can be operated at milder conditions of lower pressure and temperature than would otherwise be possible if the heteroatoms had not been removed. In an enbodiment shown in FIG. 1, milder dewaxing conditions, and particularly a lower dewaxing pressure, permit both dewaxing and hydrotreating stages to be in the same reaction vessel with gas flow between dewaxing and hydrotreating. The amount of dissolved and entrained $H_2S$ and $NH_3$ removed by stripping prior to dewaxing, while minor, would be desirable to prevent a reduction in dewaxing catalyst activity, should a sulfur or nitrogen sensitive dewaxing catalyst be used, such as one that dewaxes mostly by isomerization and not by cracking. A higher treat gas to liquid ratio will reduce the partial pressure, in the dewaxing stage, of any remaining $H_2S$ and $NH_3$ in the waxy liquid, thereby contributing to preventing a reduction in dewaxing catalyst activity which is particularly important with a heteroatom sensitive dewaxing catalyst.

By heteroatoms is meant primarily sulfur and nitrogen, which are present in the feed as sulfur and nitrogen containing compounds, but the term also includes oxygen in oxygen containing compounds. In the one or more hydrotreating reaction stages, the feed reacts with hydrogen in the presence of a catalytically effective amount of a hydrotreating catalyst under catalytic hydrotreating conditions, to produce a hydrotreated fuel having fewer heteroatoms. Sulfur and nitrogen in organic heteroatom compounds in the feed are removed as $H_2S$ and $NH_3$, with oxygen removed as $H_2O$. The hydrotreating also converts at least a portion of aromatics and other unsaturates that may be present by hydrogenating them. The sulfur content of the feed may vary, but will typically be from about 0.5 to about 2.0 wt. % sulfur in the form of various sulfur-bearing compounds. If previously hydrotreated, the feed sulfur could be lower than about 0.5 wt. % (e.g., about 500 wppm). The nitrogen content of the feed will range from about 20 to about 2000 wppm and preferably no more than about 300 wppm. By way of an illustrative, but nonlimiting example, these feeds are hydrotreated to reduce the respective sulfur and nitrogen content to from about 5 to about 100 wppm and about 10 to about 100 wppm, depending on the impurity levels in the feed. Improved low temperature properties, include one or more of lower pour, cloud, freeze and CFPP temperatures. Low temperature property requirements will vary depending on the fuel and some depend on the geographical location in which the fuel will be used. For example, jet fuel should have a freeze point of no higher than about −47° C. Diesel fuel has both summer and winter cloud point specifications, varying by region, from about −15 to about +5° C. and about −35 to about −5° C. Both fuels have fuel filter plugging requirements. Heating oils typically have low pour point requirements. The feed may be derived from light and heavy whole and reduced crude oils, as straight run distillates, from vacuum tower resids, cycle oils, FCC tower bottoms, gas oils, vacuum gas oils, deasphalted residua, tar sands, shale oil and the like. The heavier sources tend to have more heteroatom impurities and therefore require more severe processing.

As discussed, the invention relates to a fuel upgrading process involving hydrotreating followed by dewaxing a portion of the hydrotretaed feed. The hydrotreating will be described first, followed by a description of the dewaxing. As used herein, hydrotreating refers to a process in which a feed to be hydrotreated and a hydrogen-containing treat gas react in the presence of one or more suitable catalysts primarily active (selective) for the removal of heteroatoms, such as sulfur, and nitrogen, and for the saturation of aromatics and other unsaturates with hydrogen. Conventional hydrotreating catalysts can be used including, for example, catalysts comprising one or more Group VIII metal catalytic components, preferably Fe, Co and Ni, more preferably Co and/or Ni, and most preferably Co; and one or more Group VI metal catalytic components, preferably Mo and W, more preferably Mo, on a high surface area support material, such as alumina. The Groups referred to herein refer to Groups as found in the Sargent-Welch Periodic Table of the Elements copyrighted in 1968 by the Sargent-Welch Scientific Company. Other suitable hydrotreating catalysts include zeolitic catalysts, as well as noble metal catalysts, wherein the noble metal is selected from Pd and Pt. It is within the scope of the present invention that more than one type of hydrotreating catalyst may be used in the same reaction stage or zone. Catalysts useful for saturating aromatics include nickel, cobalt-molybdenum, nickel-molybdenum, nickel-tungsten and noble metal (e.g., platinum and/or palladium) catalysts, with the noble metal catalysts being sulfur sensitive, but more selective for aromatics removal. Typical non-noble metal hydrotreating catalysts include, for example, Ni/Mo on alumina, Co/Mo on alumina, Co/Ni/Mo on alumina, and the like. Hydrotreating conditions typically include temperatures in the range of from about 530 to about 750° F. (about 277 to about 400° C.), preferably about 600 to about 725° F. (about 316 to about 385° C.), most preferably about 600 to about 700° F. (about 316 to about 371° C.), at a total pressure in the range of about 400 to about 2000 psi, at a hydrogen treat gas rate in the range from about 300 to about 3000 SCF/B (about 53 to about 534 S $m^3$ of $H_2/m^3$ of oil), and a feed space velocity of about 0.1 to about 2.0 LHSV. In an embodiment, the hydrotreating conditions are selected so as to be sufficient to vaporize at least a portion of the lighter feed fraction, but not the wax-containing heavy fraction, thereby eliminating the need for a separate fractionation or distillation zone for separating the two fractions. However, if desired and/or if distillation capacity is available, separation of the light fraction may be achieved using fractional distillation. It will be understood by those skilled in the art that, unlike fractional distillation, reaction conditions effective to vaporize the light fraction in one or more hydrotreating stages may result in some of the heavy fraction being vaporized and some of the lighter fraction remaining in the heavy liquid. This is acceptable for the hydrotreating of this embodiment. Having described the hydrotreating, the dewaxing can now be more fully described.

By dewaxing herein is meant catalytic dewaxing in which the waxy, heavy fraction reacts with hydrogen in the presence of a dewaxing catalyst at reaction conditions effective to reduce its pour and cloud points, and increase the cold cranking performance of the dewaxed fuel. While some hydrotreating catalyst compositions may be used to dewax the heavy fraction (e.g., those which include one or more of Co, Ni and Fe and which will typically also include one or more of Mo or W, as well as Pt and Pd noble metals on an acidic support such as alumina, as is known), in some cases it will be preferred to employ a dewaxing catalyst that dewaxes mostly by isomerization and not by cracking, to maximize yield of the dewaxed fuel. However, this may not always be a viable option. The dewaxing is conducted at reaction conditions which include a temperature ranging from about 300 to about 900° F. (about 149 to about 482° C.), preferably about 550 to about 800° F. (about 289 to about 427° C.) and pressures in the range of from about 400-2000 psig. The hydrogen containing treat gas rate will range between about 300 to about 5000 SCF/B (about 53 to about 890 S $m^3/m^3$) with a preferred range of about 2000 to about 4000 SCF/B (about 356 to about 712 S $m^3/m^3$), while the liquid hourly space velocity, in volumes/volume/hour (V/V/Hr), will range between about 0.1 to about 10 and preferably about 1 to about 5. The acidic oxide support or carrier may include silica, alumina, silica-alumina, shape selective molecular sieves which, when combined with at least one catalytic metal component, have been demonstrated as useful for dewaxing such as silica-alumina-phosphates, titania, zirconia, vanadia, and other Group II, IV, V or VI oxides, ferrierite, mordenite, ZSM-5, ZSM-11, ZSM-23, ZSM-35, ZSM-22 also known as theta one or TON, ZSM-48 and the silicoaluminophosphates known as SAPO's, including SAPO-11, 36, 37 and 40 as well as Y sieves, such as ultra stable Y sieves and like, as is known. If stripping is not available prior to dewaxing and/or if the sulfur content of the hydrotreated and separated heavy fraction is high enough to result in dewaxing catalyst activity reduction or loss, zeolites containing framework transition metals having improved sulfur resistance (c.f., U.S. Pat. Nos. 5,185,136; 5,185,137 and 5,185,138) may be employed.

A treat gas is used in the hydrotreating and dewaxing. The terms "hydrogen", "hydrogen treat gas" and "treat gas" are used synonymously herein, and may be either pure hydrogen or a hydrogen-containing treat gas which is a treat gas stream containing hydrogen in an amount at least sufficient for the intended reaction(s), plus other gas or gasses (e.g., nitrogen and light hydrocarbons such as methane) which will not adversely interfere with or affect either the reactions or the products. Impurities, such as $H_2S$ and $NH_3$ are undesirable and would typically be removed from the treat gas before it is conducted to the reactor. The treat gas stream introduced into a reaction stage will preferably contain at least about 50 vol. % and more preferably at least about 75 vol. % hydrogen.

A distillate fuel base stock produced by this process may be hydrofinished at mild conditions, to improve color and stability, to form a finished fuel base stock. Hydrofinishing is a very mild, relatively cold hydrogenating process, which employs a catalyst, hydrogen and mild reaction conditions to remove trace amounts of heteroatom compounds, aromatics and olefins, to improve oxidation stability and color. Hydrofinishing reaction conditions typically include a temperature of from about 300 to about 660° F. (about 150 to about 350° C.) and preferably from about 300 to about 480° F. (about 150 to about 250° C.), a total pressure of from about 400 to about 2000 psig. (about 2859 to about 20786 kPa), a liquid hourly space velocity ranging from about 0.1 to about 10 LHSV ($hr^{-1}$) and preferably about 0.5 to about 5 $hr^{-1}$. The hydrogen treat gas rate will range from about 2550 to about 10000 scf/B (about 44.5 to about 1780 $m3/m^3$). The catalyst will comprise a support component and one or catalytic metal components of metal from Groups VIB (Mo, W, Cr) and/or iron group (Ni, Co) and noble metals (Pt, Pd) of Group VIII. The metal or metals may be present from as little as about 0.1 wt. % for noble metals, to as high as about 30 wt. % of the catalyst composition for non-noble metals. Preferred support materials are low in acid and include, for example, amorphous or crystalline metal oxides such as alumina, silica, silica alumina and ultra large pore crystalline materials known as mesoporous crystalline materials, of which MCM-41, available from the ExxonMobil Company, is a preferred support component. The preparation and use of MCM-41 is disclosed, for example, in U.S. Pat. Nos. 5,098,604, 5,227,353 and 5,573,657.

Two related embodiments will be described with reference to the Figures. For the sake of simplicity, not all process reaction vessel internals, valves, pumps, heat transfer devices etc. are shown. Also, units and streams common to the embodiments of both Figures have the same numbers and features. Thus, what is described for a common unit with regard to FIG. 1, is not necessarily repeated for the same unit in FIG. 2. Referring now to FIG. 1, a combined distillate fuel hydrotreating and dewaxing unit 10 is schematically illustrated as having a hydrotreating reaction stage and a dewaxing reaction stage in the same vessel 12. Thus, unit 10 comprises a hollow, cylindrical reactor 12, a stripper 14, gas-liquid separation drums 16 and 18, and a heat exchanger 20. The two reaction stages in 12 comprise a hydrotreating stage and a dewaxing stage, each respectively defined by one or more beds of hydrotreating catalyst and dewaxing catalyst, illustrated as 22 and 24, respectively. These two reaction stages are separated by a chimney type gas-liquid separation tray 26, and each stage has a respective gas and liquid flow distributor, 28 and 30, located near the top of the bed. In this illustration, the gaseous effluent from the dewaxing stage flows directly down into the hydrotreating stage below. In this embodiment, one or more existing hydrotreating stages can readily be converted to dewaxing stages, with the hydrotreating catalyst previously used in these stages replaced by a dewaxing catalyst, or a reactor may be installed having both dewaxing and hydrotreating stages in it. Stripper 14 comprises two stripping stages 32 and 34, separated by a chimney type gas-liquid separation tray 36, with the dewaxed fuel stripping stage 34 located below the hydrotreated heavy fuel fraction stripping stage 32. Each stripping stage preferably contains packed beds (not shown) of high surface area packing material, such as conventional structured packing trays and the like, or both, to enhance the efficacy of the stripping. An existing, single or multi-stage stripper used for stripping only hydrotreated liquid, can be converted to two stages by means well known in the art, to separately strip the hydrotreated and dewaxed liquids. In the process illustrated in FIG. 1, a feed comprising a waxy, heteroatom-containing diesel fuel fraction boiling in the range of about 400 to about 700° F. (about 204 to about 371° C.) is passed, via feed line 38, into the hydrotreating reaction stage 22 located below the dewaxing reaction stage 24. At the same time, the hydrogen-rich gas effluent from the dewaxing reaction stage 24 above, is passed down into stage 22 through the chimneys in tray 26. While not shown, fresh treat gas may also be passed into the hydrotreating stage, to increase the hydrogen for the hydrotreating. The gas and the feed pass down through the gas and liquid flow distributor 28, and into and through the one or more hydrotreating catalyst beds 22, at hydrotreating reaction conditions effective for the feed to react with the hydrogen in the presence of the catalyst, to remove heteroatoms and aromatics. The one or more catalyst beds may contain the same or different catalysts. While not shown, a sequential plurality of the same or different hydrotreating catalyst beds may be vertically separated from each other, with gas and liquid flow distribution means between them, defining a plurality of hydrotreating zones in the hydrotreating stage, wherein the entire effluent from a preceding zone flows into the next sequential zone. In one embodiment the heteroatoms will be removed first, with the waxy, heteroatom-reduced feed then passed down through one or more catalyst beds more effective for aromatics removal. The hydrotreating reaction vaporizes hydrocarbons boiling below about 500° F. (about 260° C.) and produces a hydrotreating stage effluent comprising the hydrotreated liquid heavy fraction and a gaseous effluent comprising the hydrotreated and vaporized light fraction, along with gaseous reaction products which include unreacted hydrogen, $H_2S$ and $NH_3$. Most of the wax is concentrated in the liquid heavy fraction, which is passed to separator drum 16 via line 40. The hydrotreated liquid heavy fraction comprises less than about 60 and preferably less than about 80 vol.% of the feed entering 22 via line 38. Optional cooling means such as an indirect heat exchanger (not shown) may be included with line 40 upstream of 16, if desired to condense some of the vaporized feed to liquid. The hydrotreating reaction conditions can vary during the hydrotreating and therefore the extent of feed vaporization occurring from the hydrotreating can vary. Also, separation of the light and heavy hydrocarbon fractions in a drum is not nearly as precise as fractionation. Therefore, some of the waxy heavy fraction may also be vaporized and this cooling means option may be useful when too much of the heavy liquid fraction is being vaporized in 22. In drum 16, the hydrotreated waxy liquid comprises the waxy, heavy diesel fraction. This fraction is preferably less than about 80 and more preferably less than about 60 vol. % of the total feed, and is separated from the reaction gas and hydrotreated fuel vapor in 16. This heavy fraction liquid is passed into the upper stripping stage 32 of stripper 14, via line 42. The heteroatom-reduced, light fuel fraction vapor and the gaseous reaction products are removed from 16 via line 44, and passed through heat exchanger 20, in which the vaporized light fraction is cooled and condensed out as liquid. The resulting liquid and gaseous reaction products are then passed into separation drum 18, via line 46.

In the stripper (14), the hydrotreated, waxy heavy fuel fraction liquid contacts a steam stripping gas flowing up through the gas-liquid separation tray 36, from the dewaxed fuel stripping stage 34 below. The steam strips dissolved and entrained heteroatom compounds ($H_2S$, $NH_3$ and $H_2O$) out of the heavy liquid. In addition to resulting in less dewaxing catalyst activity loss downstream, stripping out the dissolved heteroatom compounds enables the use of a more heteroatom sensitive dewaxing catalyst, such as those that dewax mostly by isomerization and not by cracking. A catalyst that dewaxes mostly by isomerization produces a greater yield of dewaxed fuel, because less of it is cracked into hydrocarbons, including methane, boiling below the desired fuel range. The stripped heavy liquid collects on tray 36 and is withdrawn from the stripper via line 52, with the steam and stripped components passing up and out the top of the stripper via line 50. Line 52 passes the stripped heavy liquid into line 56 and then down into the dewaxing reaction stage 24 in vessel 12. At the same time, a hydrogen treat gas is passed, via lines 54 and 56, down into the dewaxing stage. Flow distributor 30 distributes the downflowing hydrogen treat gas and the liquid, waxy, stripped and hydrotreated heavy diesel fraction across the top of the one or more dewaxing catalyst beds 24. The dewaxing catalyst may comprise one or more separate and sequential beds of the same or different dewaxing catalyst, as a plurality of dewaxing zones, into each of which the entire effluent from a preceding zone passes. In dewaxing reaction stage 24, the hydrogen reacts with the waxy components in the hydrotreated and stripped heavy diesel fraction to reduce its pour and cloud points, and improve its low temperature properties. The dewaxing reaction is operated at milder conditions than would otherwise be possible if dissolved $H_2S$ and $NH_3$ had not been removed from the heavy fraction and/or if the entire feed, instead of only the heavy fraction, was being dewaxed. The smaller volume of waxy feed being dewaxed results in an increased liquid residence time and a concomitant increased hydrogen treat gas to waxy hydrocarbon ratio in the dewaxing stage. The stripping prior to dewaxing reduces the $H_2S$ and $NH_3$ partial pressures in the dewaxing stage, and the higher treat gas to liquid ratio further decreases them. This means the dewaxing catalyst activity will be higher and the dewaxing temperature and pressure can be lower. The hydrogen treat gas introduced into 24 preferably contains enough hydrogen for both the dewaxing and hydrotreating reactions. The hydrotreated and dewaxed liquid collects on tray 26, from which it is removed via line 58.

In this particular illustration, the condensed, hydrotreated light fuel fraction is separated from the heteroatom-containing, gaseous hydrotreating reaction products in drum 18, and passed via line 60, into line 58, where it recombines with the hydrotreated and dewaxed heavy diesel fraction. The gaseous reaction products from drum 18 are conducted away from the process via line 62 for storage or further processing, e.g., $H_2S$ and $NH_3$ clean up. The cleaned gas may be used as fuel or, if it contains sufficient unreacted hydrogen, it may be passed into one of the reaction stages as a source of hydrogen. Line 58 passes the combined fractions into the lower stage 34 of the stripper. In 34, the combined fractions are stripped with steam entering the bottom of the stripper via line 48. In both stripping stages 32 and 34, the stripping removes dissolved $H_2S$, $NH_3$, $H_2O$, hydrogen and light, normally gaseous (e.g., $C_1$-$C_4$) hydrocarbons. A hydrotreated, dewaxed and stripped diesel stock is removed from 14 via line 49. If needed, and irrespective of whether or not the diesel stock comprises only the heavy fraction or has been recombined with the light fraction, the diesel stock can be mildly hydrofinished either before or after stripping.

While only two stages are shown in this illustration of an embodiment, more than two stages may be used for either or all of the hydrotreating, dewaxing and stripping. For example, the disclosure of U.S. Pat. No. 5,705,052, which is incorporated herein by reference, illustrates the use of three reaction stages in a single vessel, in combination with three stripping stages in a single stripper. Those skilled in the art will appreciate that these configurations can also be applied to four or more stages, if desired. Further, while cocurrent gas and liquid flow is shown in the hydrotreating and catalytic dewaxing stages above, one or more stages could have countercurrent gas and liquid flow.

Figure 2:
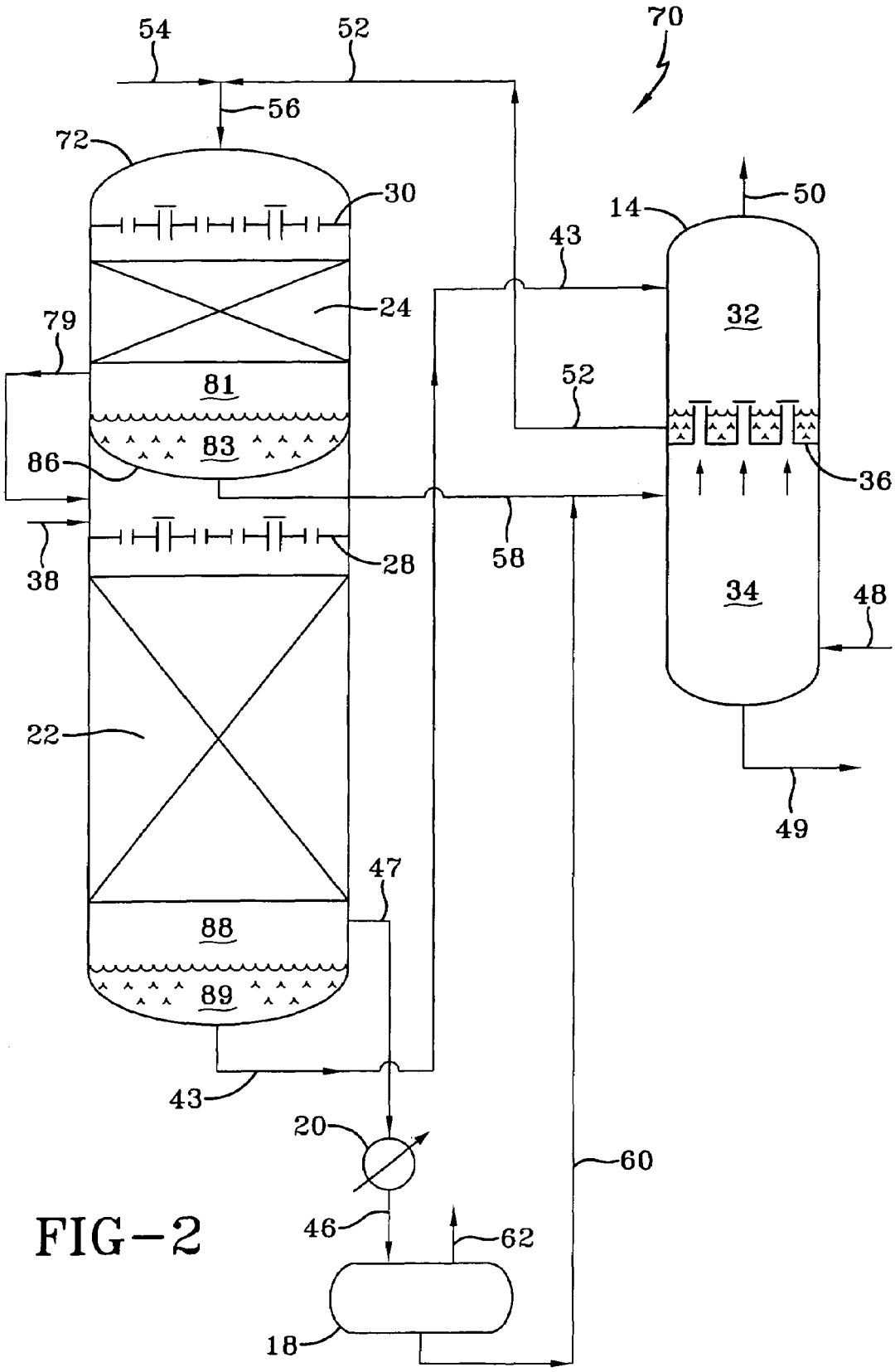
FIG. 2 is a schematic flow diagram of an embodiment in which hydrotreating and dewaxing stages are in a single vessel operated in blocked fashion.

FIG. 2 schematically illustrates an embodiment in which one hydrotreating stage and one dewaxing stage are used, but in which both stages are in a single reaction vessel that is blocked off into two separate stages, as if there were two separate reaction vessels. Thus, a combined distillate fuel hydrotreating and dewaxing unit 70 comprises a reactor vessel 72, a stripper 14, a gas-liquid separation drum 18 and a heat exchanger 20. The catalytic dewaxing stage is defined by one or more catalyst beds illustrated as 24, with a gas and liquid flow distributor 30 located near the top. A gas and liquid-impermeable partition 86 separates and isolates the dewaxing stage 24, from the hydroireating stage 22 below. In this type of arrangement, a single reaction vessel can be retrofitted by placing the partition 86 into the vessel. Alternately, a smaller reactor for the dewaxing can be placed on top of an existing hydrotreating reactor, provided the hydrotreating reactor and its foundation are able to support the additional weight. Either way, it represents another way of enabling an existing hydrotreating reactor to be retrofitted or converted into a dual function reactor for hydrotreating and catalytically dewaxing distillate fuel. The same feed used in the FIG. 1 illustration is conducted, via feed line 38 above distributor 28, where it combines with the hydrogen-rich dewaxing reaction gas effluent removed from gas space 81 below 24, but above 86, and passed below 86 and above 28 via line 79. The combined treat gas and feed pass down through the gas and liquid flow distributor 28 and into and through the one or more hydrotreating catalyst beds 22, at hydrotreating reaction conditions effective for the feed to react with the hydrogen in the gas to remove heteroatoms and aromatics. The one or more catalyst beds may contain the same or different catalysts, as is disclosed for the FIG. 1 embodiment. The feed hydrocarbons boiling below the range of from about 450 to about 580° F. are vaporized in this stage to produce the same hydrotreating stage effluent produced in the FIG. 1 process. However, in this embodiment the hydrotreated light fraction vapor and the gaseous reaction products pass into a gas-liquid separation space under 22, where the gaseous effluent is separated from the hydrotreated heavy liquid 89, which collects at the bottom of the reactor as shown.

The hydrotreated heavy liquid is removed via line 43 and passed into the top stripping stage 32, of the stripper 14. The separated gaseous effluent comprising the hydrotreated light faction vapor and gaseous reaction products is removed from gas separation space 88 via line 47 and passed through heat exchanger 20, which cools and condenses the hydrotreated vapor to liquid. As in FIG. 1, the mixture of condensed liquid and gaseous reaction products are passed into separation drum 18, where they are separated. The liquid is removed from 18 via line 60 and the gaseous reaction products via line 62. As in FIG. 1, the condensed light fraction is passed, via line 60 to line 58, where it recombines with the hydrotreated and dewaxed heavy fraction. The stripped, waxy heavy fraction is removed from 14 via line 52 and passed into the dewaxing stage 24, via line 56. Fresh hydrogen treat gas is passed into 24 via lines 54 and 56. The hydrogen treat gas and the hydrotreated and stripped heavy liquid are distributed over the dewaxing stage catalyst by gas and liquid distributor 30. The same reactions, catalyst, configurations and dewaxing stage effluent is produced here as in 24 of FIG. 1, but with the hydrotreated and dewaxed liquid heavy fraction collecting above 86 as liquid 83, which is removed and passed via line 58, into the stripper in this embodiment, with the hydrogen-rich gaseous effluent passed to 80 via line 79, instead of passing down through a tray. This permits the option of operating the dewaxing stage at a higher pressure than the hydrotreating stage. A further option is the use of a heat exchanger with line 79, to heat or cool the hydrogen-rich dewaxing reaction gaseous effluent before it passes into the hydrotreating stage. The streams going into and out of the stripper 14 are the same as those described for FIG. 1, and need not be repeated here. The hydrotreated, dewaxed and stripped fuel is removed from the stripper via line 49 and sent to blending or storage. The options of hydrofinishing, the use of multiple stages, countercurrent flow, etc., described with respect to FIG. 1, also apply to this embodiment.

What is claimed is:

1. A process for removing heteroatoms and wax from a distillate fuel feed having an end boiling point of about 700° F. comprising:

(i) hydrotreating the feed in one or more hydrotreating reaction stages to produce a hydrotreated feed reduced in heteroatoms, (ii) separating said treated feed, at a cut point from about 450° F. to about 580° F., into a light fraction boiling below about the cut point and a heavy fraction boiling above about the cut point, and (iii) dewaxing said heavy fraction in one or more dewaxing reaction stages, to improve one or more low temperature properties.

2. A process according to claim 1 wherein said feed and hydrotreated heavy fraction is liquid.

3. A process according to claim 2 wherein said heavy fraction comprises less tan about 80 vol. % of said feed on a liquid basis.

4. A process according to claim 3 wherein said light faction is separated from said hydrotreated fuel as vapor.

5. A process according to claim 4 wherein unreacted hydrogen from said dewaxing is used for said hydrotreating.

6. A process according to claim 5 wherein said hydrotreated heavy fraction liquid is stripped to remove dissolved heteroatom compounds before said dewaxing.

7. A process according to claim 6 wherein at least one said dewaxing stage is in a hydrotreating reactor in which there are one or more said hydrotreating stages.

8. A process according to claim 7 wherein at least a portion of said separated light fraction is condensed to liquid and recombined with at least a portion of said dewaxed heavy fraction liquid.

9. A process according to claim 8 wherein said heavy fraction comprises less than about 60 vol. % of said feed on a liquid basis.

10. A process for removing heteroatoms and wax from a distillate fuel feed having an end boiling point of about 700° F. comprising (a) passing hydrogen and a wax and heteroatom-containing distillate fuel feed into one or more hydrotreating stages, at reaction conditions effective for the feed and hydrogen to react in the presence of a hydrotreating catalyst, to produce a feed reduced in heteroatoms, (b) separating the heteroatom-reduced feed, at a cut point from about 450° to about 580° F., into a light fraction boiling below about the cut point and a heavy fraction liquid boiling above about the cut point, and (c) passing the separated heavy fraction liquid and hydrogen into one or more dewaxing reaction stages, at reaction conditions effective for the hydrogen to react with the heavy fraction in the presence of a dewaxing catalyst, to improve one or more low temperature properties.

11. A process according to claim 10 wherein said hydrotreating reaction conditions vaporize at least most of said light fraction, to produce a hydrotreated light fraction vapor and a hydrotreated heavy fraction liquid and wherein said vapor is separated from said liquid.

12. A process according to claim 10 wherein said hydroireated heavy fraction liquid is stripped to remove dissolved heteroatom compounds before said dewaxing.

13. A process according to claim 12 wherein said heavy fraction comprises less than about 80 vol. % of said feed on a liquid basis.

14. A process according to claim 13 wherein unreacted hydrogen from said dewaxing is used for said hydrotreating.

15. A process according to claim 14 wherein said hydrotreated heavy fraction liquid is stripped to remove dissolved heteroatom compounds before said dewaxing.

16. A process according to claim 15 wherein said one or more dewaxing stages have been added to an existing hydroteating facility.

17. A process according to claim 16 wherein at least a portion of said separated light fraction is condensed to liquid and recombined with at least a portion of said dewaxed heavy fraction liquid.

18. A process according to claim 16 wherein said combined light and heavy fractions are stripped.

19. A process according to claim 18 wherein said recombined light and heavy fractions and said hydrotreated heavy liquid fraction are stripped with a stripping gas in separate stages in a single stripper and wherein said gas first strips said dewaxed product and then said heavy liquid prior to its being dewaxed.

20. A distillate fuel hydrotreating process comprising (a) adding one or more catalytic dewaxing stages to a distillate fuel hydrotreating facility comprising one or more hydrotreating stages, (b) passing hydrogen and a wax and heteroatom-containing distillate fuel feed having an end boiling point of about 700° F. into said one or more hydrotreating stages in said facility, at reaction conditions effective for said feed and hydrogen to react in the presence of a hydrotreating catalyst, to (i) produce a feed reduced in heteroatoms and (ii) vaporize at least a portion of the lighter feed components to produce a light fraction vapor boiling below about a cut point and a heavy fraction liquid boiling above about the cut point, the cut point being from about 450° F. to about 580° F., (c) separating said heavy fraction liquid from said light fraction vapor, and (d) passing said heavy fraction liquid and hydrogen into said one or more dewaxing reaction stages, at reaction conditions effective for said hydrogen to react with said heavy fraction in the presence of a dewaxing catalyst, and improve one or more low temperature properties.

* * * * *